US006955401B1

(12) United States Patent
Shoulberg

(10) Patent No.: US 6,955,401 B1
(45) Date of Patent: Oct. 18, 2005

(54) COLLAPSIBLE ROCKER CHAIR

(76) Inventor: Jon Shoulberg, 224 E. 11th St., apt. 18, New York, NY (US) 10003-7327

( * ) Notice: Subject to any disclaimer, the term of this patent is extended or adjusted under 35 U.S.C. 154(b) by 0 days.

(21) Appl. No.: 10/761,997

(22) Filed: Jan. 20, 2004

(51) Int. Cl.[7] ..... A47C 7/00
(52) U.S. Cl. ..... 297/440.13; 297/440.15; 297/440.23
(58) Field of Search ..... 297/440.1, 440.13, 297/440.15, 440.2, 440.21, 440.23, 271.6

(56) References Cited

U.S. PATENT DOCUMENTS

| | | | | |
|---|---|---|---|---|
| 1,910,089 A | * | 5/1933 | Chomik | 5/102 |
| 2,486,987 A | | 11/1949 | Scarlett | |
| 2,723,788 A | * | 11/1955 | Lund | 223/107 |
| 2,792,877 A | | 5/1957 | West, Jr. | |
| 3,527,497 A | | 9/1970 | Self | |
| 3,909,064 A | * | 9/1975 | Payne et al. | 297/440.23 |
| 4,225,180 A | | 9/1980 | Gillis | |
| 4,348,052 A | * | 9/1982 | Roland | 297/440.13 |
| 4,509,794 A | | 4/1985 | Roland | |
| 4,593,950 A | | 6/1986 | Infanti | |
| 5,000,514 A | | 3/1991 | Hanson | |
| 5,765,922 A | * | 6/1998 | Hsia | 297/440.1 |
| 5,803,548 A | | 9/1998 | Battle | |
| 5,927,816 A | | 7/1999 | Hsu | |
| 6,247,754 B1 | | 6/2001 | Vanderaue et al. | |

FOREIGN PATENT DOCUMENTS

| | | |
|---|---|---|
| GB | 2.274.773 | 8/1994 |
| WO | WO 01/76419 | 10/2001 |

* cited by examiner

*Primary Examiner*—Peter M. Cuomo
*Assistant Examiner*—Stephen Vu
(74) *Attorney, Agent, or Firm*—Michael I. Kroll

(57) ABSTRACT

A collapsible rocker chair includes a back member having an top section and a base having first locking holes extending through said base at a first and second distal end thereof. A seat member includes second locking holes extending therethrough. The chair also includes first and second sideboards each having a curvilinear base. Each of the sideboards includes a first slot extending from an edge thereof and a second slot positioned substantially perpendicular to the first slot. The further includes a first and second locking member each having a crescent shape. The first distal end of the base is inserted though the second slot of the first sideboard and the second distal end of the base is inserted through the second slot in the second side board so that said first locking holes are positioned on an exterior side of each of said first and second sideboards. The seat member is inserted into the first slot in each of said first and second sideboards thereby causing said second locking holes to be perpendicularly aligned with said first locking holes on said exterior side thereof. The first and second locking members are received through the first locking holes and further through the second locking holes thereby locking the back member and the seat member between each of the first and second sideboards.

10 Claims, 10 Drawing Sheets

COLLAPSIBLE ROCKER CHAIR

BACKGROUND OF THE INVENTION

1. Field of the Invention

The present invention relates generally to chairs and, more specifically, to a collapsible rocker chair formed from planar members that interlock without the need of an adhesive or bonding agent thereby making the rocker easy to disassemble and portable. The planar members include a back and seat member for supporting the user while seated in the chair. Two sideboards are positioned on each side of the back and seat member thereby form the chair of the present invention. The sideboards have a curvilinear base providing means for rocking once assembled. A locking member selectively connects the seat and back members to each of the sideboards thereby allowing a user to rock the chair while seated therein.

2. Description of the Prior Art

There are other collapsible chairs designed for relative purpose. Typical of these is U.S. Pat. No. 2,486,987 issued to Scarlett on Nov. 1, 1949. Another patent was issued to West on May 21, 1957 as U.S. Pat. No. 2,792,877. Yet another U.S. Pat. No. 3,527,497 was issued to Self on Sep. 8, 1970 and still yet another was issued on Sep. 30, 1980 to Gillis as U.S. Pat. No. 4,225,180. Another patent was issued to Roland on Apr. 9, 1985 as U.S. Pat. No. 4,509,794. Yet another U.S. Pat. No. 4,593,950 was issued to Infanti on Jun. 10, 1986. Another was issued to Hanson on Mar. 19, 1991 as U.S. Pat. No. 5,000,514 and still yet another was issued on Sep. 8, 1998 to Battle U.S. Pat. No. 5,803,548. Another patent was issued to Hsu on Jul. 27, 1999 as U.S. Pat. No. 5,927,816. Yet another U.S. Pat. No. 6,247,754 was issued to Vanderaue et al. on Jun. 19, 2001. Another was issued to Atkinson on Aug. 10, 1994 as U.S. Pat. No. 2,274,773 and still yet another was issued on Oct. 18, 2001 to LaPointe as U.S. Pat. No. WO 01/76419 A1.

While these collapsible chair devices may be suitable for the purposes for which they were designed, they would not be as suitable for the purposes of the present invention, as hereinafter described.

U.S. Pat. No. 2,486,987

Inventor: George R. Scarlett

Issued: Nov. 1, 1949

The invention provides a take apart chair of the character comprising a pair of side frames each having upper and lower sections integrally connected together, said lower section having a ground engaging portion at the bottom and a seat ledge portion at the top, each frame having at the base of said upper section a notch with a side overlying said ledge, said lower section also having therein an aperture, a rung extending between the sections and through the apertures therein and having end portions engaging the inner and outer sides of the frames adjacent the apertures, a seat member resting upon said ledges and having the rear portion thereof inserted within said notches and provided with notches near the rear edge thereof for the reception of the base portion of said upper sections, said upper sections having at the top thereof an upwardly opening notch, and a back member having portions seated in said last mentioned notches and a portion interlocked with said seat member to retain said seat member in the first mentioned notches.

U.S. Pat. No. 2,797,877

Inventor: Thomas F. West

Issued: May 21, 1957

A knocked down furniture, comprising two duplicate flat side members each having a bottom portion, an upright portion above said bottom portion centrally located and with a width less than the median width of said bottom portion, and a top portion above said upright portion centrally located and if a width less than said upright portion, a seat portion having a leg opening, slots embracing the two upright portions of said side members respectively and a rear transverse slot, an arm rest portion having a body opening, two slots embracing the two top portions of said side members and a transverse back slot, a back member having a tab portion extending into the rear transverse slot of said seat portion, and a tab portion extending through the transverse back slot of said arm rest portion, and a locking member extending between and connecting the two said side members.

U.S. Pat. No. 3,527,497

Inventor: Raymond L. Self

Issued: Sep. 8, 1970

A multipurpose convertible knockdown chair comprising a plurality of cooperating panels.

U.S. Pat. No. 4,225,180

Inventor: RObert E. Gillis

Issued: Sep. 30, 1980

A collapsible chair is provided which can be easily fabricated from a sheet material such as plywood. The chair consists of two rocker elements, a seat and a back. The four elements can be stored and shipped flat and easily erected into chair form without the use of tools or fastening elements.

U.S. Pat. No. 4,509,794

Inventor: Billy F. ROland

Issued: Apr. 9, 1985

A joint for assembling planar members of a knock down chair and a box made from an assembly of interlocking pieces requiring no fasteners is disclosed. The various members can be made from a single sheet of commercially available plywood. When the last planar member is assembled in place the other planar members remain assembled in interlocking relationship preventing unintended disassembly.

U.S. Pat. No. 4,593,950

Inventor: Vittorio Infanti

Issued: Jun. 10, 1986

A child's knock-down chair capable of being assembled without the need for any conventional fasteners and comprised of two side parts and two cross pieces which, due to the unique design of the chair, act respectively as seat and back for a steady chair, and as a back and seat for a rocking chair. Disassembly of the knock-down chair is as simple and straightforward as assembly.

U.S. Pat. No. 5,000,514

Inventor: Milo D. Hanson

Issued: Mar. 19, 1991

A miniature rocking chair is composed of five separate, generally planar, interlocking members: two identical side members, a back member having a rear seat support transversely formed thereon, a seat member, and a front seat support and locking member. The back member is attached to the two side members by upward facing openings on its side edges engaging downward facing openings on the back edge of the side members. The seat member is connected to the side members through rearward facing openings which engage a forward facing opening in each side member, the rear edge of the seat member occupying a position atop the rear seat support member. The front seat support and locking member then is inserted within the forward facing opening of the side members, beneath the seat member, to a position where openings formed in its bottom edge are aligned with notches formed in the lower edge of the forward facing opening of the seat member. The front seat support and locking member then is axially rotated ninety degrees so that its openings and the notches become engaged and its upper edge presses against the lower face of the seat member, forming a front transverse seat support, while the seat member is forced against a rearward location on the side member's forward opening, thereby locking both the seat member against the side members and the rear of the seat member on top of the rear seat support, the latter serving to lock the back member onto the side members.

U.S. Pat. No. 5,803,548

Inventor: Elizabeth Taylor Battle

Issued: Sep. 8, 1998

A collapsible chair apparatus includes a pair of planar side panels each of which includes a lower side panel portion which includes a front lower region and a rear lower region. Each side panel also includes an upper side panel portion which extends upward from the rear lower region. A front slot extends into the front lower region. A lower rear slot extends into the rear lower region. An upper rear slot extends into the upper side panel portion and is coplanar with the lower rear slot. A planar back panel includes a pair of lower back slots which are registrable with the lower rear slots of the side panels. A pair of upper back slots in the back panel are registrable with the upper rear slots of the side panels. A lock-tab receiving channel is present in the back panel and is coplanar with the front slots of the side panels. A seat assembly includes a planar seat panel and a spacer element which projects downward from a front portion of the seat panel. The seat panel includes a rear locking tab that is registrable with the lock-tab receiving channel in the back panel and includes a pair of rear seat slots which are registrable with the front slots of the side panels. A locking element is provided which is attachable to the rear locking tab of the seat assembly for locking the seat assembly onto the back panel.

U.S. Pat. No. 5,927,816

Inventor: Kevin Hsu

Issued: Jul. 27, 1999

A collapsible safe rocking chair includes a main body, two step plates, two rocking plates, a supporter, a seat, and a grip. All the components are made of foam material to make the rocking chair safe to use by children. The two step plates are releasably combined under the main body for two feet to step on, and the two rocking plates are releasably combined under the two step plates to make the chair rock on the ground. The seat is releasably combined on the supporter and on the main body for a child to sit on, with the grip releasably combined on a front end portion of the main body for a user to grip with two hands.

U.S. Pat. No. 6,247,754

Inventor: Daniel A. Vanderaue et al.

Issued: Jun. 19, 2001

A chair (20) formed out of two side panels (22, 24) and a seat panel (26). The side panels are formed with complementary slots (32, 34) that allow the side panels to be interlocked. The seat panel is formed to have wings (44) that extend out from the sides of the seat panel adjacent the front of the seat panel. The wings seat in slots (48) that extend rearwardly from the front ends of the side panels. The seat panel is also formed with tabs (52) that extend out from the side edges of the panel. The tabs rest on support surfaces (54, 55) formed on the side panels. The assembly of this chair does not require the use of any fastening tools.

U.S. Pat. No. GB 2,274,773 A

Inventor: Stephen Alexis Atkinson

Issued: 10 Aug. 1994

An article of furniture comprising a body portion and support means for supporting the body portion, the support means being arranged to be connected to the body portion by telescopic engagement.

U.S. Pat. No. WO 01/76419 A1

Inventor: Larry LaPointe

Issued: 5 Apr. 2000

A reclining chair comprising a chair frame having a pair of side panels, a seat attachable to said chair frame and an adjustable frame rail having a pair of connection brackets secured to said panels and an interlinking rail secured to said connection brackets, said adjustable frame rail operable in a first mode to permit relative movement of said pair of side panels for facilitating alignment between said chair frame and said seat back and operable in a second mode to rigidly secure said pair of side panels together, thus enabling said chair frame to be a rigid structure.

SUMMARY OF THE PRESENT INVENTION

The present invention relates generally to chairs and, more specifically, to a collapsible rocker chair formed from planar members that interlock without the need of an adhesive or bonding agent thereby making the rocker easy to disassemble and portable. The planar members include a back and seat member for supporting the user while seated in the chair. Two sideboards are positioned on each side of the back and seat member thereby form the chair of the present invention. The sideboards have a curvilinear base providing means for rocking once assembled. A locking member selectively connects the seat and back members to each of the sideboards thereby allowing a user to rock the chair while seated therein.

A primary object of the present invention is to provide a collapsible rocker chair that overcomes the shortcomings of the prior art.

Another, secondary object of the present invention is to provide a collapsible rocker chair formed from planar, interlocking members.

Another object of the present invention is to provide a collapsible rocker chair having a back, seat, left and right side members, armrests and locking elements.

Yet another object of the present invention is to provide a collapsible rocker chair wherein the back member has a curvilinear base with a locking hole extending through a right and left side of the base.

Still another object of the present invention is to provide a collapsible rocker chair wherein the base further includes locking notched on an edge of the base positioned closest to the floor.

A further object of the present invention is to provide a collapsible rocker chair wherein the side boards have a rectangular slot extending therethrough.

Another object of the present invention is to provide a collapsible rocker chair wherein each rectangular slot receives either a right or left side of the base of the back member so that the locking hole is positioned on an outer side of the side board and a bottom of the slot is received within a respective locking notch of the base for securing the back member to the side members.

A further object of the present invention is to provide a collapsible rocker chair wherein each side board has a curvilinear base.

Still a further object of the present invention is to provide a collapsible rocker chair wherein each sideboard includes a plurality of tenons extending from an edge opposite the curvilinear base.

Another object of the present invention is to provide a collapsible rocker chair having eye-shaped arm rests, each arm rest include mortise joints for mating with the tenons of the sideboards for frictional connection thereto.

A further object of the present invention is to provide a collapsible rocker chair wherein each eye-shaped armrest is cut out of a respective planar sideboard.

Yet another object of the present invention is to provide a collapsible rocker chair wherein each sideboard includes a second slot extending from a front edge thereof for receiving the planar seat member therein.

Still another object of the present invention is to provide a collapsible rocker chair wherein the planar seat member includes locking holes extending therethrough along a right and left side thereof.

A further object of the present invention is to provide a collapsible rocker chair wherein upon the planar seat member being received in the second slot, a locking device is positioned through the locking holes in of the seat member and further extended through the locking holes of the base of the back member thereby locking the seat member, back member and a respective sideboard together.

Still yet another object of the present invention is to provide a collapsible rocker chair that allows the user to assemble and disassemble the rocker at their convenience.

Another object of the present invention is to provide a collapsible rocker chair that allows the user to easily transport the disassembled rocker.

Yet another object of the present invention is to provide a collapsible rocker chair that allows the user easy storage of the disassembled rocker.

Yet another object of the present invention is to provide a collapsible rocker chair that is simple and easy to use.

Still yet another object of the present invention is to provide a collapsible rocker chair device that is inexpensive to manufacture and operate.

The present invention overcomes the shortcomings of the prior art by providing a collapsible rocker chair that is composed of separate, planar, interlocking members having a back, seat, left and right side members, armrests and locking elements that engage the seat and back forming an integral part thereof. The design of the present invention allows the user to assemble and disassemble the rocker at their convenience and is easily transported and stored.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
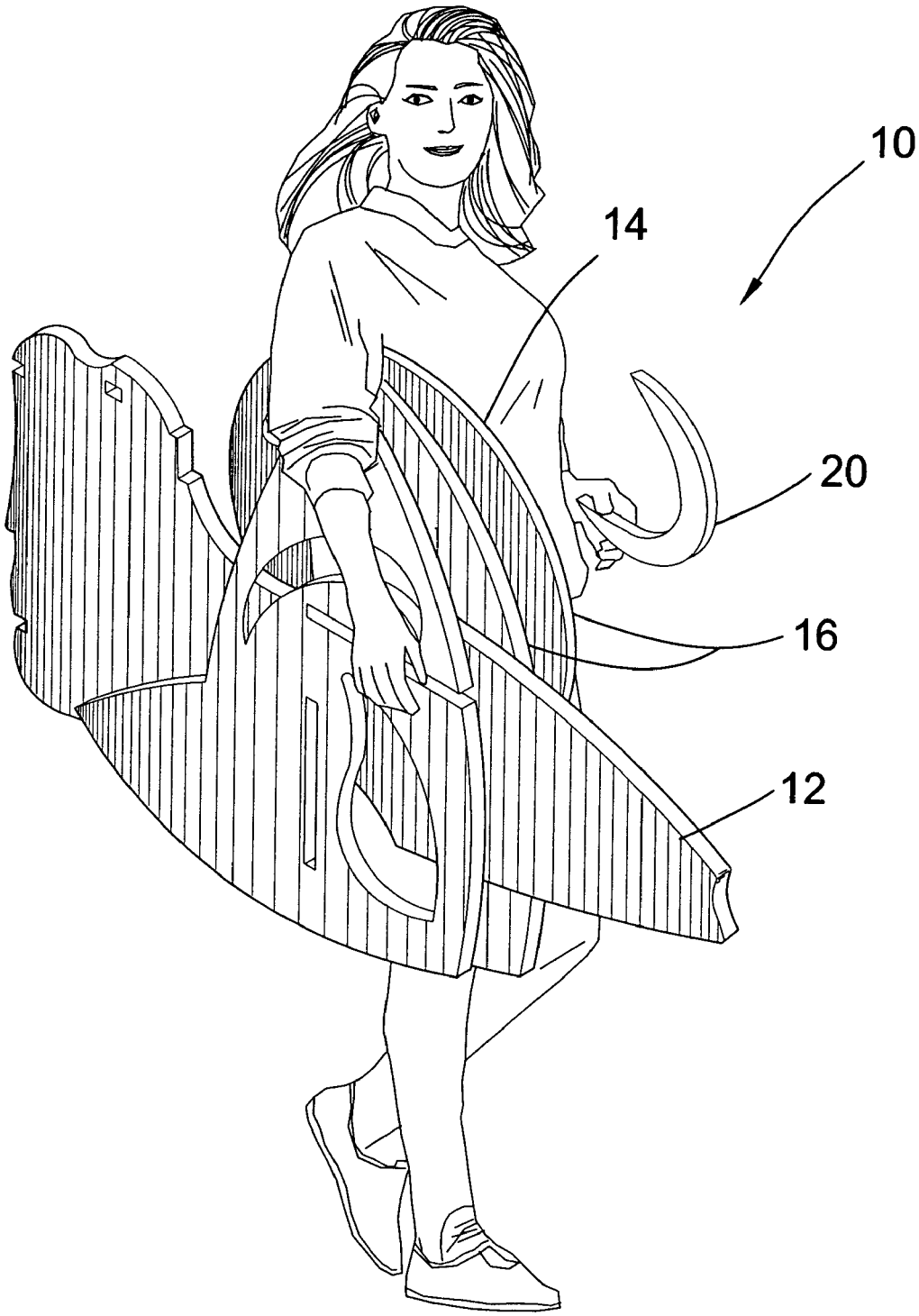
FIG. 1 is an illustrative view of the collapsible rocker chair of the present invention.

Turning now descriptively to the drawings, in which similar reference characters denote similar elements throughout the several views, the Figures illustrate the collapsible rocker chair of the present invention. With regard to the reference numerals used, the following numbering is used throughout the various drawing Figures.

10 collapsible rocker chair of the present invention
12 back member
14 seat member
16 sideboard
18 armrest
20 locking member
21 locking notch
22 first locking recess
24 second locking recess
26 tenon
28 matise joint
30 first slot
32 first cutout
34 second slot
36 second cutout

DETAILED DESCRIPTION OF THE PREFERRED EMBODIMENT

The following discussion describes in detail one embodiment of the invention. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 8 illustrate a collapsible rocker chair of the present invention indicated generally by the numeral 10.

FIG. 1 is an illustrative view of the collapsible rocker chair of the present invention, hereinafter known as "the chair". The chair 10 of the present invention is formed from planar interlocking members. The chair 10 is not held together using any adhesive or bonding agent. The chair 10 includes a back member 12, a seat member 14 and two sideboards 16. The chair 10 further includes armrests 18. Upon assembling the chair 10, as will be discussed hereinafter with specific reference to FIGS. 2–8, a locking member 20 releasably locks the seat member 14 and back member 12 between the two sideboards 16. As shown herein, the chair 10 is easily collapsible and may be transported easily as planar components.

Figure 2:
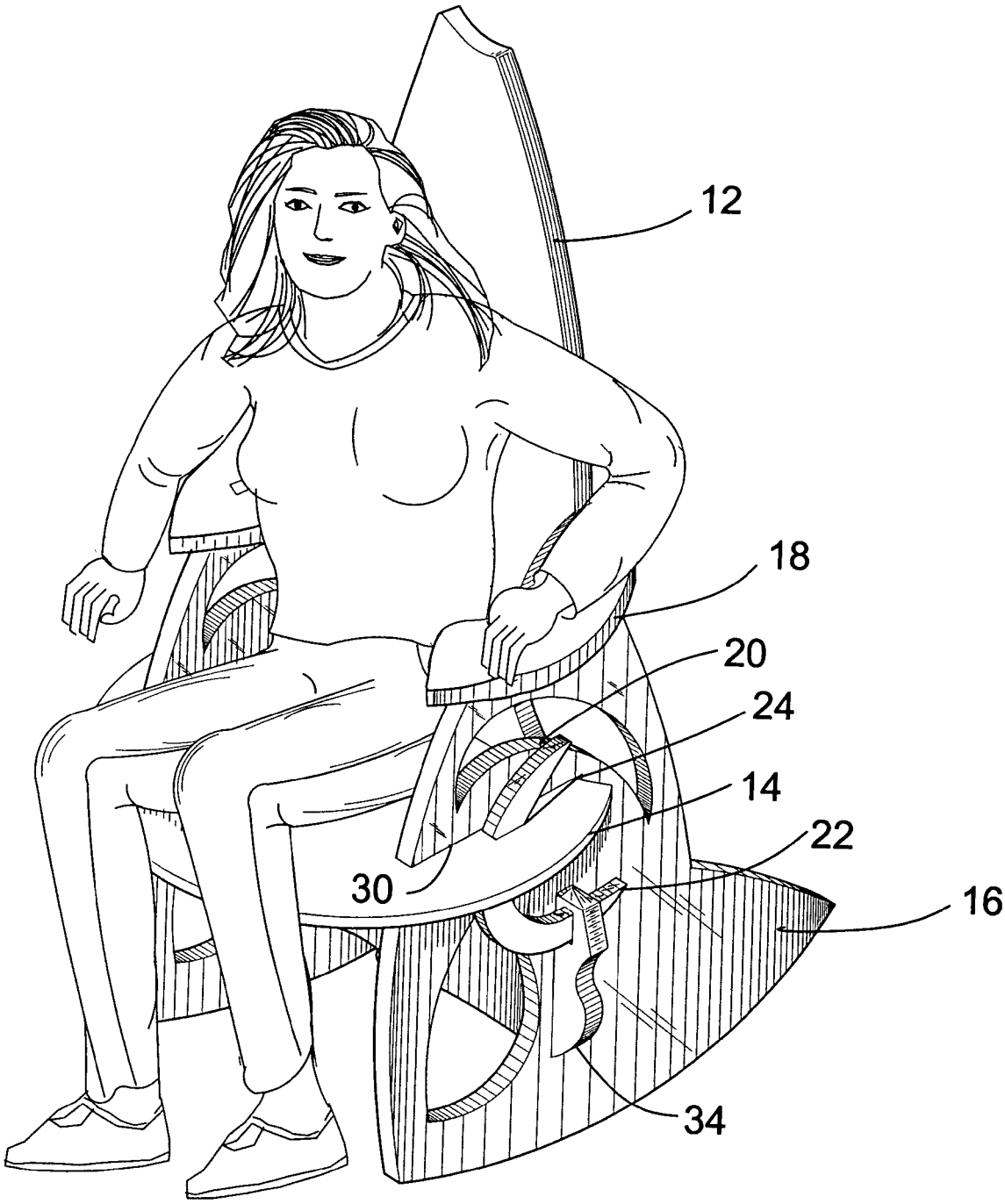
FIG. 2 is an illustrative view of the collapsible rocker chair of the present invention in use.

FIG. 2 is an illustrative view of the collapsible rocker chair of the present invention in use. The chair 10 of the present invention is formed from planar interlocking members. The chair 10 is not held together using any adhesive or bonding agent. The chair 10 includes a back member 12, a seat member 14 and two sideboards 16. The chair 10 further includes armrests 18. Upon assembling the chair 10, as will be discussed hereinafter with specific reference to FIGS. 3–8, locking members 20 releasably lock the seat member 14 and back member 12 between the two sideboards 16. When the seat chair is assembled as shown in FIG. 2, a user may sit on the seat member 14 and position their back against the back member 12. The user can then rock back and forth in the chair 10 of the present invention.

Figure 3:
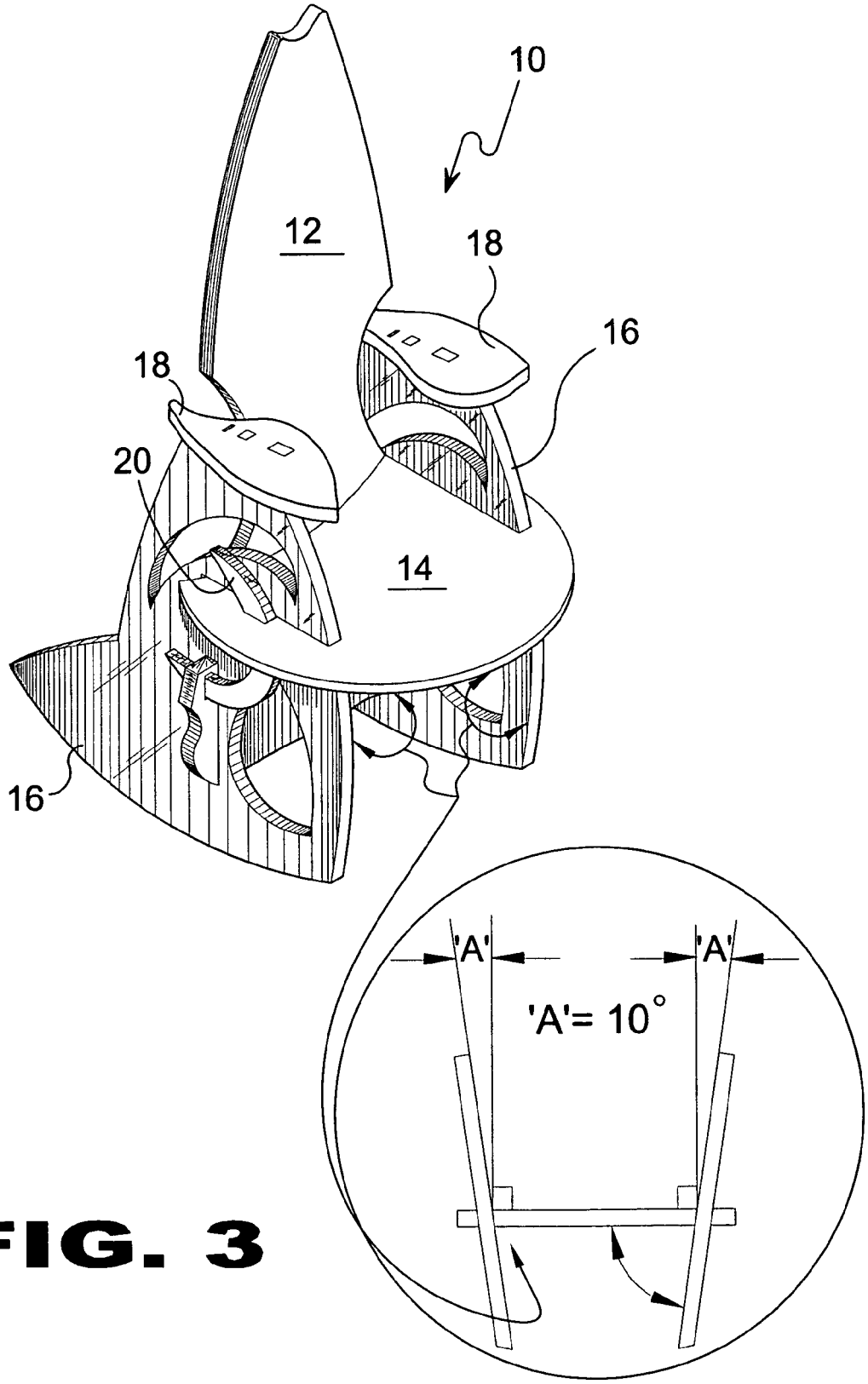
FIG. 3 is a perspective view of the collapsible rocker chair of the present invention assembled.

FIG. 3 is a perspective view of the collapsible rocker chair of the present invention assembled. The chair 10 includes the back member 12, the seat member 14 and the sideboards 16. The back member 12 includes a substantially cone-shaped top section having arc-shaped cutouts on each edge of thereof. The back member further includes a curved base having a diameter larger than the top section connected to the top section adjacent to the arc shaped cutouts. The curved base includes two locking holes 22 positioned at each end of the base. The curved base also includes locking notches 21 on edge thereof. The locking notches 21 are preferably rectangular and extend inward from the edge of the base.

The seat member 14 has the shape of a three-quarter moon and thus has an arced edge with the apex of the arc positioned toward the center of the seat member 14. The seat member further includes second locking holes 24 extending therethrough. The second locking holes 24 are positioned at a predetermined positioned from each edge adjacent to the arced edge thereof.

The sideboards 16 have a curvilinear base which allow the chair, upon assembly to rock thereon. At an edge of each sideboard 16 opposite the curvilinear base are a plurality of tenons 26 extending upward therefrom. Each of the sideboards 16 include a first slot 30 and a second slot 34. The first slot 30 extends inward from an edge of the sideboard 16. The second slot 34 is a vertical rectangular cutout from the sideboard 16. The second slot 32 is substantially perpendicular to the first slot 30. The sideboards 16 have eye-shaped cutouts 32 from which the armrests 18 are removed. The armrests 18 have a shape substantially similar to the shape of the eye shaped cutouts 32. Each armrest 18 includes a plurality of matise joints 28. The matise joints 28 are aligned with the tenons 26 of the sideboards for connection thereto. The sideboards 16 further include crescent-shaped cutouts 36 from which crescent shaped locking members 20 are removed.

The chair 10 is assembled by inserting the a side of the curved base of the back member having a respective locking hole 22 through a respective second slot 34 of a sideboard 16 so that the locking hole 22 is on an outer side of the sideboard 16. The second sideboard 16 is then connected to the back member 12 in a similar manner. The sideboard 16 are each received within a respective arc-shaped cutout of the back member 12. The seat member 14 is received by the first slot 30 of each sideboard 16. The side of the seat member 14 having the arc-shaped cutout is inserted first and upon sliding the seat member 14 along the length of the first slot 30, the arced cutout of the seat member is positioned adjacent and substantially perpendicular to the back member 12. Upon the first slot 30 receiving the seat member 14, the second locking holes 24 are perpendicularly aligned with the first locking holes 22 of the base of the back member. The chair 10 is secured by inserting a crescent shaped locking member 20 through the first locking hole 22 of the back member and further through the second locking hole 24 of the seat member. The locking member is frictionally fit within the locking holes 22, 24 for retaining the each of the back member 12 and seat member 14 between the sideboards 16.

As illustrated, the present invention is comprised of planar interlocking members that once assembled form the rocking chair absent of adhesives or fasteners. The components are designed to interlock using the strength of one for the applied forces of the other.

Figure 4:
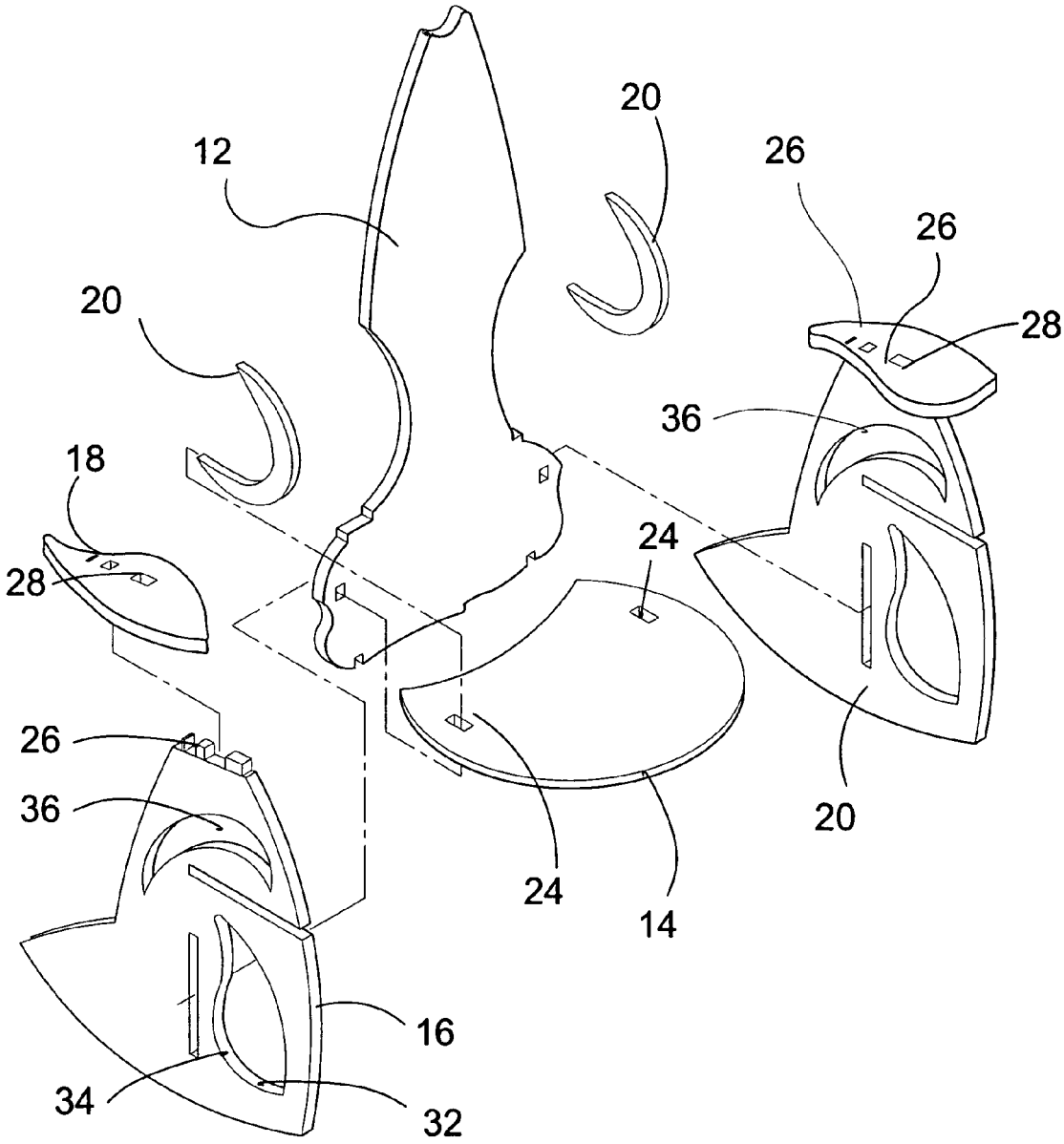
FIG. 4 is an exploded view of the collapsible rocker chair of the present invention.

FIG. 4 is an exploded view of the collapsible rocker chair of the present invention. The chair 10 includes the back member 12, the seat member 14 and the sideboards 16. The back member 12 includes a substantially cone-shaped top section having arc-shaped cutouts on each edge of thereof. The back member further includes a curved base having a diameter larger than the top section connected to the top section adjacent to the arc shaped cutouts. The curved base includes two locking holes 22 positioned at each end of the base. The curved base also includes locking notches 21 on edge thereof. The locking notches 21 are preferably rectangular and extend inward from the edge of the base.

The seat member 14 has the shape of a three-quarter moon and thus has an arced edge with the apex of the arc positioned toward the center of the seat member 14. The seat member further includes second locking holes 24 extending therethrough. The second locking holes 24 are positioned at a predetermined positioned from each edge adjacent to the arced edge thereof.

The sideboards 16 have a curvilinear base which allow the chair, upon assembly to rock thereon. At an edge of each sideboard 16 opposite the curvilinear base are a plurality of tenons 26 extending upward therefrom. Each of the sideboards 16 include a first slot 30 and a second slot 34. The first slot 30 extends inward from an edge of the sideboard 16. The second slot 34 is a vertical rectangular cutout from the sideboard 16. The second slot 32 is substantially perpendicular to the first slot 30. The sideboards 16 have eye-shaped cutouts 32 from which the armrests 18 are removed. The armrests 18 have a shape substantially similar to the shape of the eye shaped cutouts 32. Each armrest 18 includes a plurality of matise joints 28. The matise joints 28 are aligned with the tenons 26 of the sideboards for connection thereto. The sideboards 16 further include crescent-shaped cutouts 36 from which crescent shaped locking members 20 are removed.

The chair 10 is assembled by inserting the a side of the curved base of the back member having a respective locking hole 22 through a respective second slot 34 of a sideboard 16 so that the locking hole 22 is on an outer side of the sideboard 16. The second sideboard 16 is then connected to the back member 12 in a similar manner. The sideboard 16 are each received within a respective arc-shaped cutout of the back member 12. The seat member 14 is received by the first slot 30 of each sideboard 16. The side of the seat member 14 having the arc-shaped cutout is inserted first and upon sliding the seat member 14 along the length of the first slot 30, the arced cutout of the seat member is positioned adjacent and substantially perpendicular to the back member 12. Upon the first slot 30 receiving the seat member 14, the second locking holes 24 are perpendicularly aligned with the first locking holes 22 of the base of the back member. The chair 10 is secured by inserting a crescent shaped locking member 20 through the first locking hole 22 of the back member and further through the second locking hole 24 of the seat member. The locking member is frictionally fit within the locking holes 22, 24 for retaining the each of the back member 12 and seat member 14 between the sideboards 16.

Figure 5:
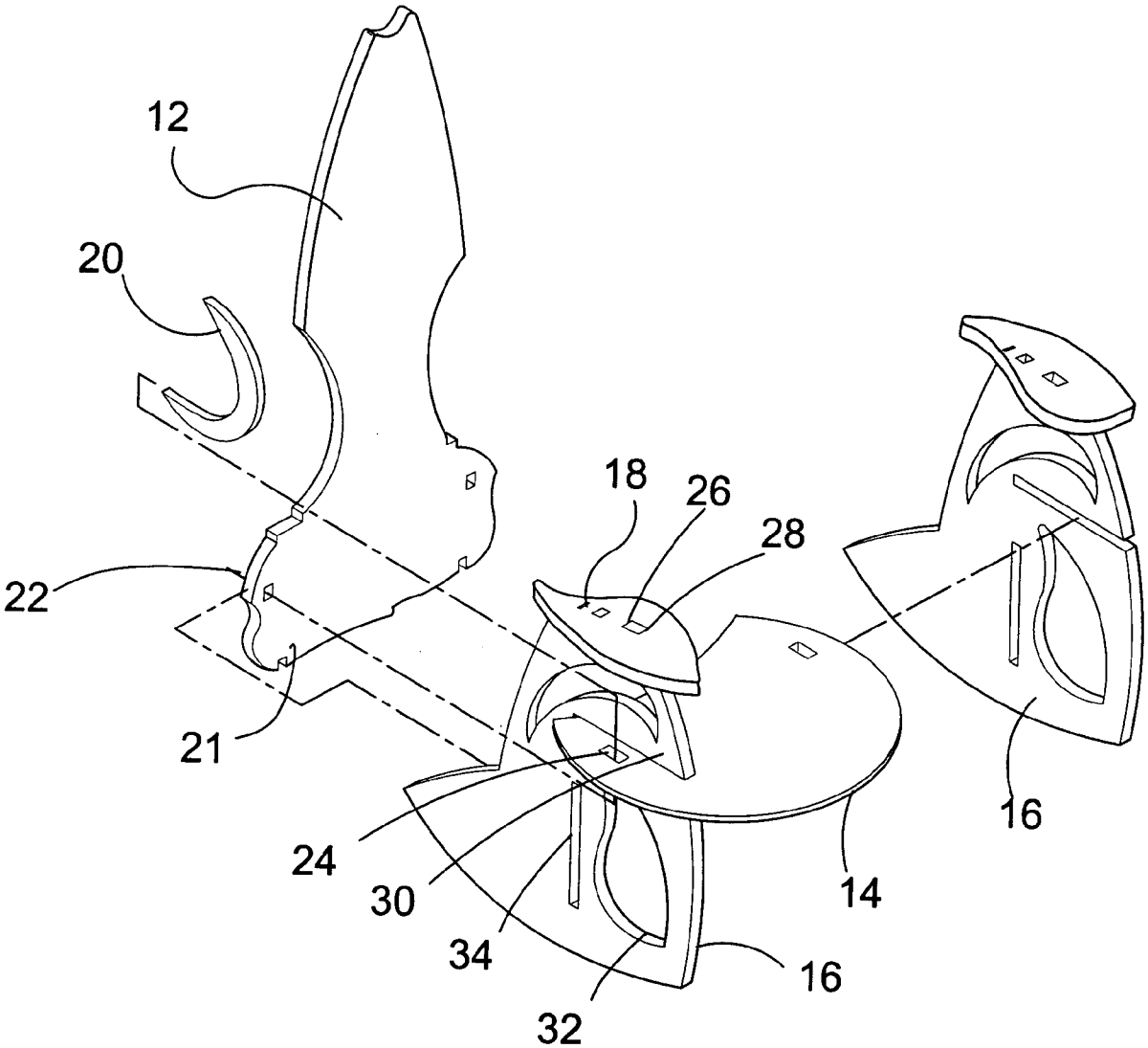
FIG. 5 is a partial exploded view of the collapsible rocker chair of the present invention.

FIG. 5 is a partial exploded view of the collapsible rocker chair of the present invention. The chair 10 includes the back member 12, the seat member 14 and the sideboards 16. The back member 12 includes a substantially cone-shaped top section having arc-shaped cutouts on each edge of thereof. The back member further includes a curved base having a diameter larger than the top section connected to the top section adjacent to the arc shaped cutouts. The curved base includes two locking holes 22 positioned at each end of the base. The curved base also includes locking notches 21 on edge thereof. The locking notches 21 are preferably rectangular and extend inward from the edge of the base.

The seat member 14 has the shape of a three-quarter moon and thus has an arced edge with the apex of the arc positioned toward the center of the seat member 14. The seat member further includes second locking holes 24 extending therethrough. The second locking holes 24 are positioned at a predetermined positioned from each edge adjacent to the arced edge thereof.

The sideboards 16 have a curvilinear base which allow the chair, upon assembly to rock thereon. At an edge of each sideboard 16 opposite the curvilinear base are a plurality of tenons 26 extending upward therefrom. Each of the sideboards 16 include a first slot 30 and a second slot 34. The first slot 30 extends inward from an edge of the sideboard 16. The second slot 34 is a vertical rectangular cutout from the sideboard 16. The second slot 32 is substantially perpendicular to the first slot 30. The sideboards 16 have eye-shaped cutouts 32 from which the armrests 18 are removed. The armrests 18 have a shape substantially similar to the shape of the eye shaped cutouts 32. Each armrest 18 includes a plurality of matise joints 28. The matise joints 28 are aligned with the tenons 26 of the sideboards for connection thereto. The sideboards 16 further include crescent-shaped cutouts 36 from which crescent shaped locking members 20 are removed.

The chair 10 is assembled by inserting the a side of the curved base of the back member having a respective locking hole 22 through a respective second slot 34 of a sideboard 16 so that the locking hole 22 is on an outer side of the sideboard 16. The second sideboard 16 is then connected to the back member 12 in a similar manner. The sideboard 16 are each received within a respective arc-shaped cutout of the back member 12. The seat member 14 is received by the first slot 30 of each sideboard 16. The side of the seat member 14 having the arc-shaped cutout is inserted first and upon sliding the seat member 14 along the length of the first slot 30, the arced cutout of the seat member is positioned adjacent and substantially perpendicular to the back member 12. Upon the first slot 30 receiving the seat member 14, the second locking holes 24 are perpendicularly aligned with the first locking holes 22 of the base of the back member. The chair 10 is secured by inserting a crescent shaped locking member 20 through the first locking hole 22 of the back member and further through the second locking hole 24 of the seat member. The locking member is frictionally fit within the locking holes 22, 24 for retaining the each of the back member 12 and seat member 14 between the sideboards 16.

Figure 6:
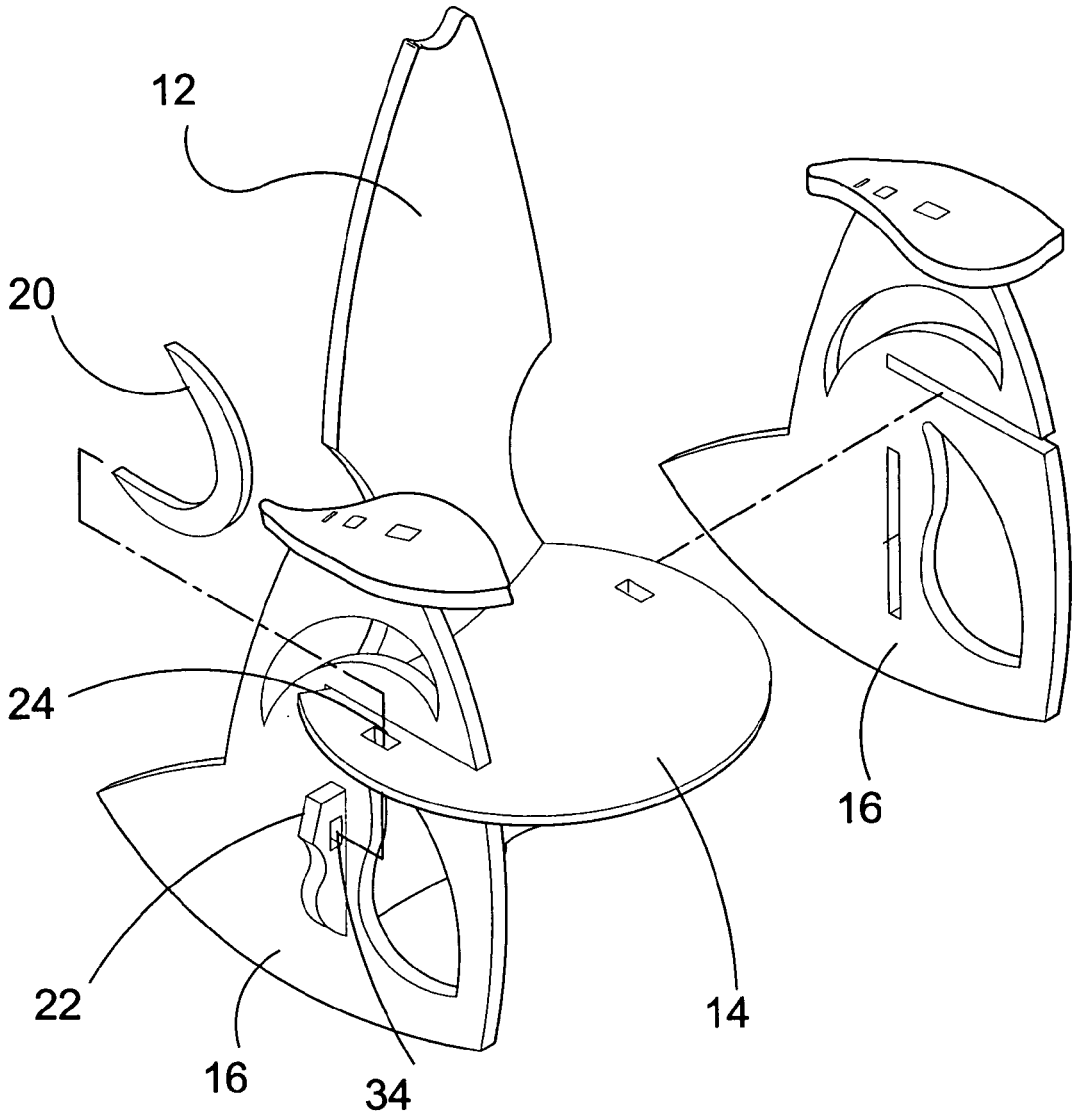
FIG. 6 is a partial exploded view of the collapsible rocker chair of the present invention.

FIG. 6 is a partial exploded view of the collapsible rocker chair of the present invention. The chair 10 includes the back member 12, the seat member 14 and the sideboards 16. The back member 12 includes a substantially cone-shaped top section having arc-shaped cutouts on each edge of thereof. The back member further includes a curved base having a diameter larger than the top section connected to the top section adjacent to the arc shaped cutouts. The curved base includes two locking holes 22 positioned at each end of the base. The curved base also includes locking notches 21 on edge thereof. The locking notches 21 are preferably rectangular and extend inward from the edge of the base.

The seat member 14 has the shape of a three-quarter moon and thus has an arced edge with the apex of the arc positioned toward the center of the seat member 14. The seat member further includes second locking holes 24 extending therethrough. The second locking holes 24 are positioned at a predetermined positioned from each edge adjacent to the arced edge thereof.

The sideboards 16 have a curvilinear base which allow the chair, upon assembly to rock thereon. At an edge of each sideboard 16 opposite the curvilinear base are a plurality of tenons 26 extending upward therefrom. Each of the sideboards 16 include a first slot 30 and a second slot 34. The first slot 30 extends inward from an edge of the sideboard 16. The second slot 34 is a vertical rectangular cutout from the sideboard 16. The second slot 32 is substantially perpendicular to the first slot 30. The sideboards 16 have eye-shaped cutouts 32 from which the armrests 18 are removed. The armrests 18 have a shape substantially similar to the shape of the eye shaped cutouts 32. Each armrest 18 includes a plurality of matise joints 28. The matise joints 28 are aligned with the tenons 26 of the sideboards for connection thereto. The sideboards 16 further include crescent-shaped cutouts 36 from which crescent shaped locking members 20 are removed.

The chair 10 is assembled by inserting the a side of the curved base of the back member having a respective locking hole 22 through a respective second slot 34 of a sideboard 16 so that the locking hole 22 is on an outer side of the sideboard 16. The second sideboard 16 is then connected to the back member 12 in a similar manner. The sideboard 16 are each received within a respective arc-shaped cutout of the back member 12. The seat member 14 is received by the first slot 30 of each sideboard 16. The side of the seat member 14 having the arc-shaped cutout is inserted first and upon sliding the seat member 14 along the length of the first slot 30, the arced cutout of the seat member is positioned adjacent and substantially perpendicular to the back member 12. Upon the first slot 30 receiving the seat member 14, the second locking holes 24 are perpendicularly aligned with the first locking holes 22 of the base of the back member. The chair 10 is secured by inserting a crescent shaped locking member 20 through the first locking hole 22 of the back member and further through the second locking hole 24 of the seat member. The locking member is frictionally fit within the locking holes 22, 24 for retaining the each of the back member 12 and seat member 14 between the sideboards 16.

Figure 7:
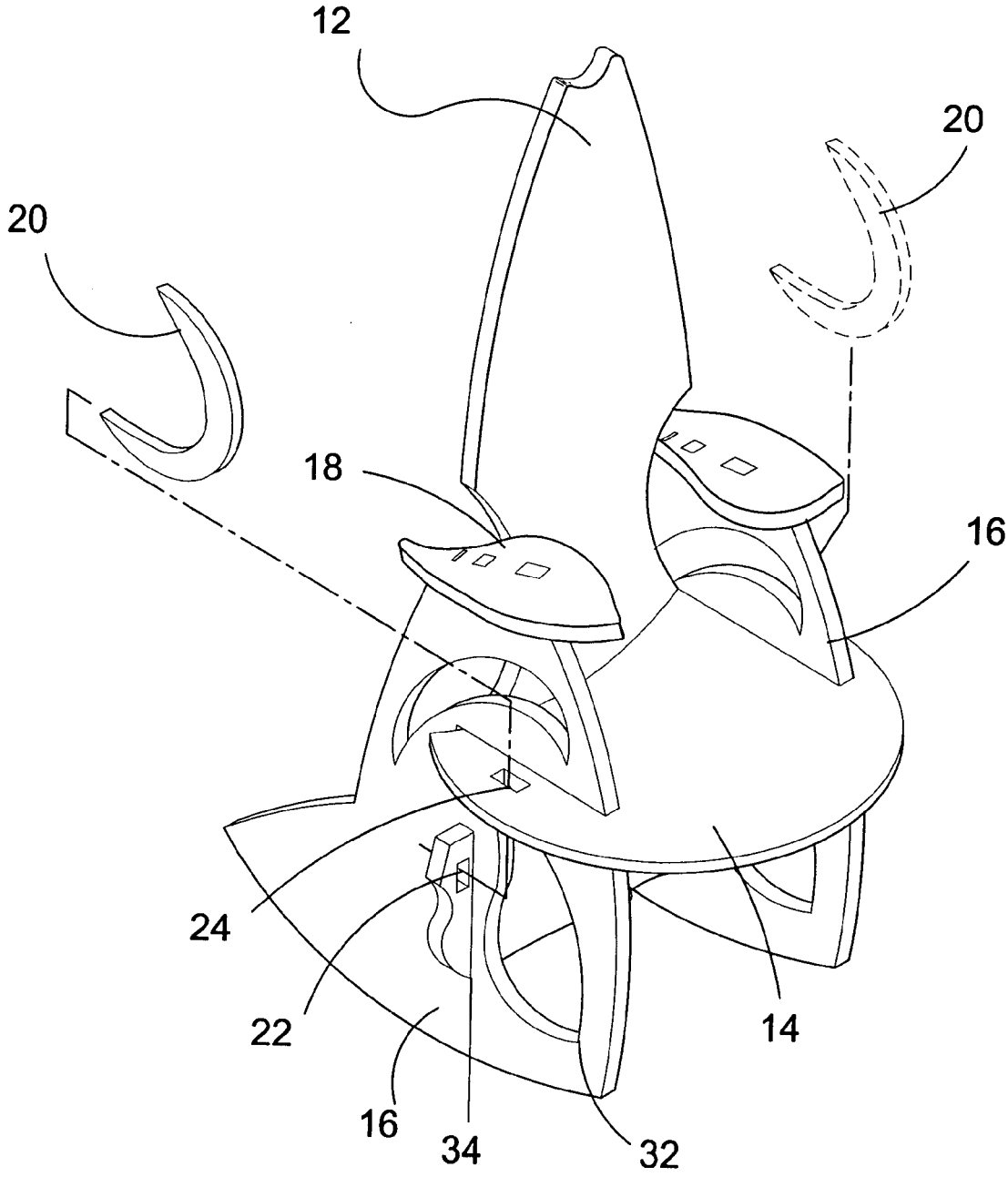
FIG. 7 is a partial exploded view of the collapsible rocker chair of the present invention.

FIG. 7 is a partial exploded view of the collapsible rocker chair of the present invention. The chair 10 includes the back member 12, the seat member 14 and the sideboards 16. The back member 12 includes a substantially cone-shaped top section having arc-shaped cutouts on each edge of thereof. The back member further includes a curved base having a diameter larger than the top section connected to the top section adjacent to the arc shaped cutouts. The curved base includes two locking holes 22 positioned at each end of the base. The curved base also includes locking notches 21 on edge thereof. The locking notches 21 are preferably rectangular and extend inward from the edge of the base.

The seat member 14 has the shape of a three-quarter moon and thus has an arced edge with the apex of the arc positioned toward the center of the seat member 14. The seat member further includes second locking holes 24 extending therethrough. The second locking holes 24 are positioned at a predetermined positioned from each edge adjacent to the arced edge thereof.

The sideboards 16 have a curvilinear base which allow the chair, upon assembly to rock thereon. At an edge of each sideboard 16 opposite the curvilinear base are a plurality of tenons 26 extending upward therefrom. Each of the sideboards 16 include a first slot 30 and a second slot 34. The first slot 30 extends inward from an edge of the sideboard 16. The second slot 34 is a vertical rectangular cutout from the sideboard 16. The second slot 32 is substantially perpendicular to the first slot 30. The sideboards 16 have eye-shaped cutouts 32 from which the armrests 18 are removed. The armrests 18 have a shape substantially similar to the shape of the eye shaped cutouts 32. Each armrest 18 includes a plurality of matise joints 28. The matise joints 28 are aligned with the tenons 26 of the sideboards for connection thereto. The sideboards 16 further include crescent-shaped cutouts 36 from which crescent shaped locking members 20 are removed.

The chair 10 is assembled by inserting the a side of the curved base of the back member having a respective locking hole 22 through a respective second slot 34 of a sideboard 16 so that the locking hole 22 is on an outer side of the sideboard 16. The second sideboard 16 is then connected to the back member 12 in a similar manner. The sideboard 16 are each received within a respective arc-shaped cutout of the back member 12. The seat member 14 is received by the first slot 30 of each sideboard 16. The side of the seat member 14 having the arc-shaped cutout is inserted first and upon sliding the seat member 14 along the length of the first slot 30, the arced cutout of the seat member is positioned adjacent and substantially perpendicular to the back member 12. Upon the first slot 30 receiving the seat member 14, the second locking holes 24 are perpendicularly aligned with the first locking holes 22 of the base of the back member. The chair 10 is secured by inserting a crescent shaped locking member 20 through the first locking hole 22 of the back member and further through the second locking hole 24 of the seat member. The locking member is frictionally fit within the locking holes 22, 24 for retaining the each of the back member 12 and seat member 14 between the sideboards 16.

Figure 8:
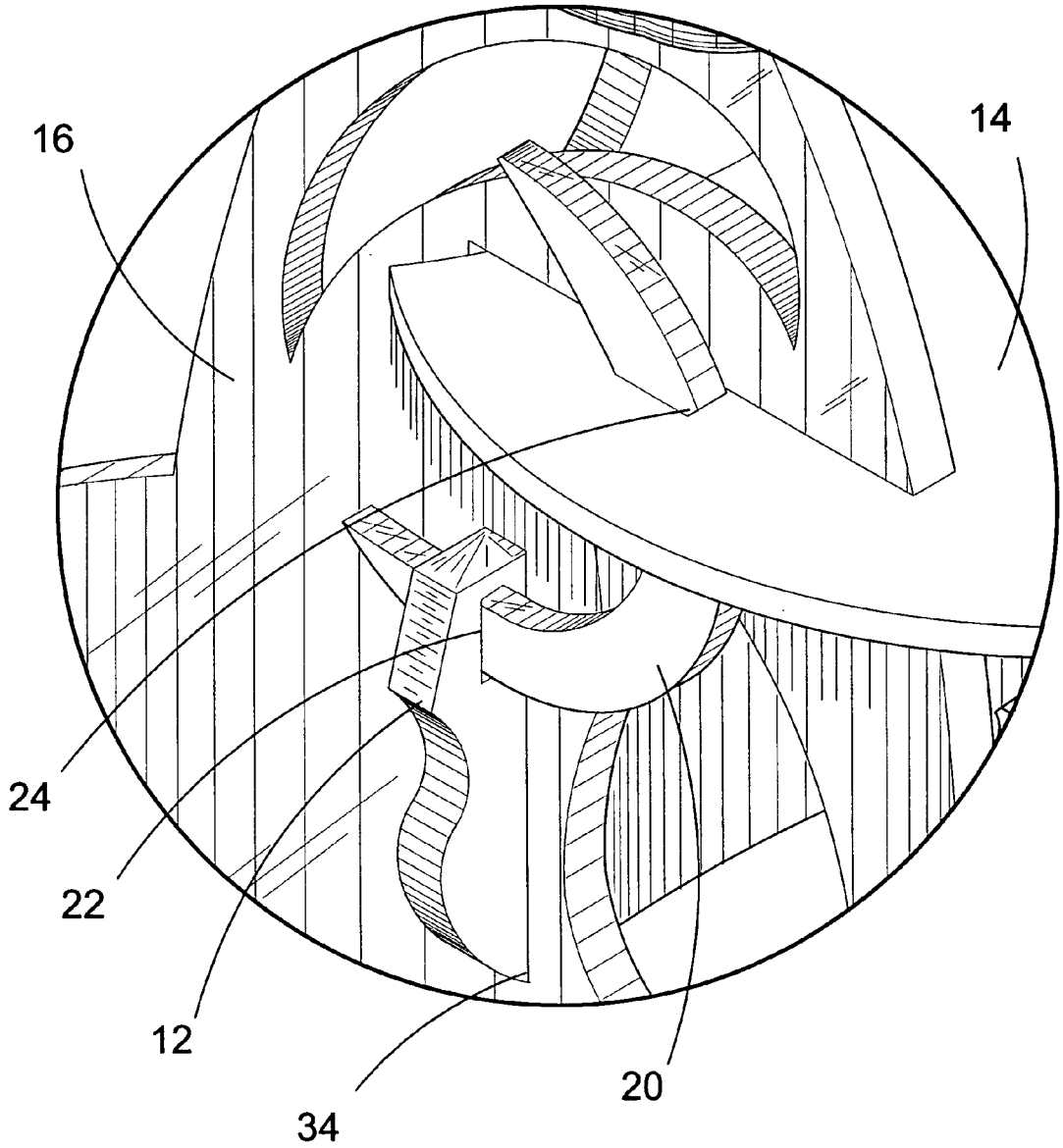
FIG. 8 is an enlarged view of the locking element of the collapsible rocker chair of the present invention.

FIG. 8 is an enlarged view of the locking element of the collapsible rocker chair of the present invention. Shown is the locking element 20 comprised of a crescent-shaped member cut from the sideboard 16. Upon inserting the base of the back member 12 into the second sideboard slot 34, the first locking holes 22 are positioned on an exterior side of the sideboard 16. Upon inserting the seat member 14 into the first slot 30, the second locking holes 24 are positioned on an exterior side of the sideboard 16. The locking holes 22 and 24 respectively are aperture passing therethrough for receiving the crescent-shaped locking member 20 for retaining the back member 12 and the seat member 14 between the sideboards 16. The chair 10 of the present invention is easily disassembled by removing the crescent-shaped locking member 20 from each of the first and second locking holes 22 and 24, respectively.

Figure 9:
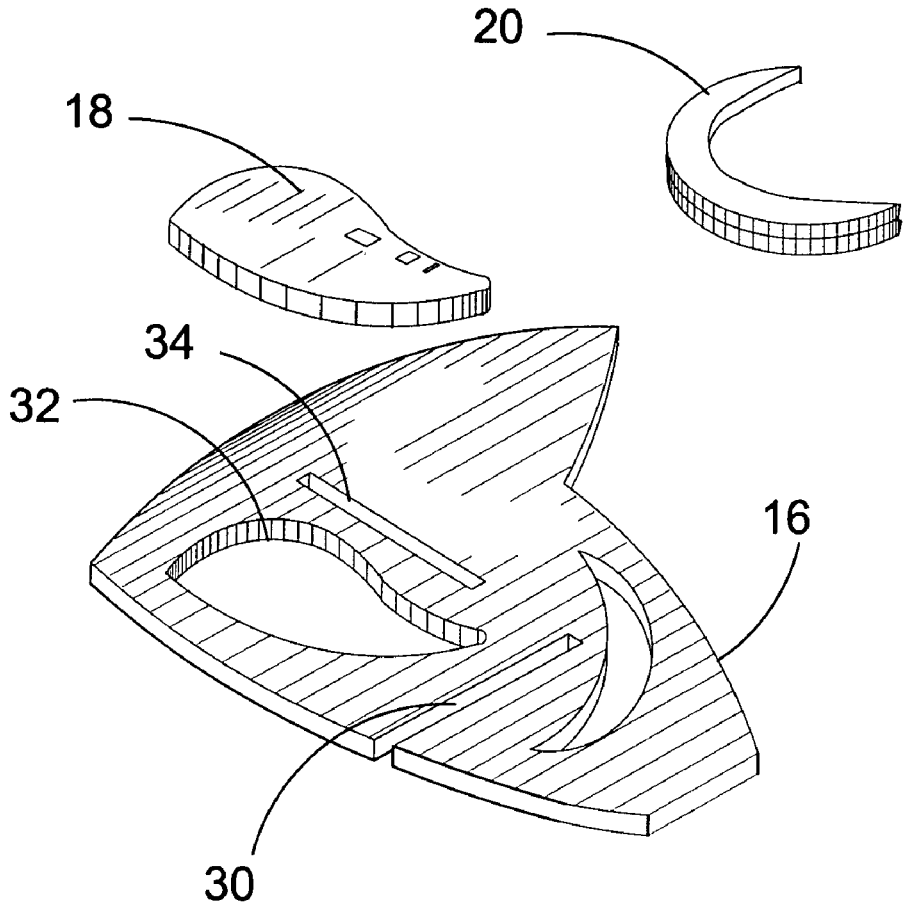
FIG. 9 is an exploded view of a sideboard of the collapsible rocker chair of the present invention showing the armrest and locking element.

FIG. 9 is an exploded view of a sideboard of the collapsible rocker chair of the present invention showing the armrest and locking element. The sideboards 16 have a curvilinear base which allow the chair, upon assembly to rock thereon. At an edge of each sideboard 16 opposite the curvilinear base are a plurality of tenons 26 extending upward therefrom. Each of the sideboards 16 include a first slot 30 and a second slot 34. The first slot 30 extends inward from an edge of the sideboard 16. The second slot 34 is a vertical rectangular cutout from the sideboard 16. The second slot 32 is substantially perpendicular to the first slot 30. The sideboards 16 have eye-shaped cutouts 32 from which the armrests 18 are removed. The armrests 18 have a shape substantially similar to the shape of the eye shaped cutouts 32. Each armrest 18 includes a plurality of matise joints 28. The matise joints 28 are aligned with the tenons 26 of the sideboards for connection thereto. The sideboards 16 further include crescent-shaped cutouts 36 from which crescent shaped locking members 20 are removed.

Figure 10:
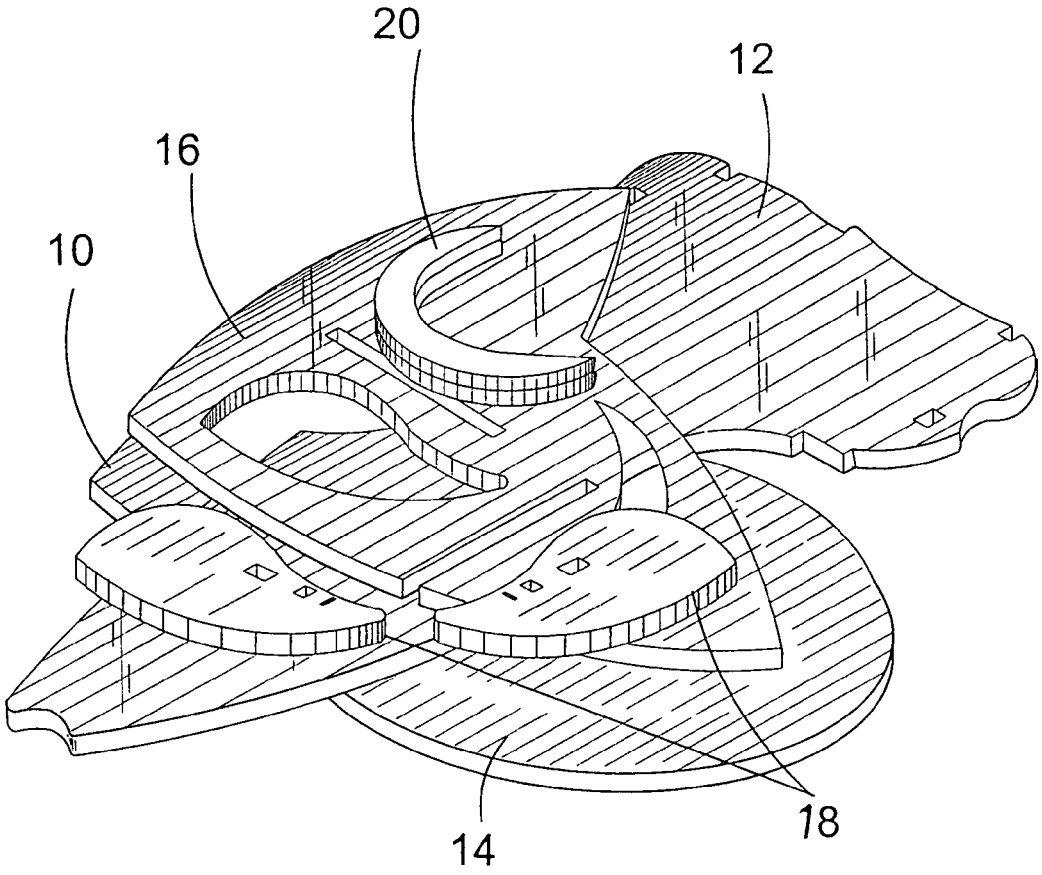
FIG. 10 is a perspective view of the collapsible rocker chair of the present invention disassembled.

FIG. 10 is a perspective view of the collapsible rocker chair of the present invention disassembled. The chair 10 includes the back member 12, the seat member 14 and the sideboards 16. The back member 12 includes a substantially cone-shaped top section having arc-shaped cutouts on each edge of thereof. The back member further includes a curved base having a diameter larger than the top section connected to the top section adjacent to the arc shaped cutouts. The curved base includes two locking holes 22 positioned at each end of the base. The curved base also includes locking notches 21 on edge thereof. The locking notches 21 are preferably rectangular and extend inward from the edge of the base.

The seat member 14 has the shape of a three-quarter moon and thus has an arced edge with the apex of the arc positioned toward the center of the seat member 14. The seat member further includes second locking holes 24 extending therethrough. The second locking holes 24 are positioned at a predetermined positioned from each edge adjacent to the arced edge thereof.

The sideboards 16 have a curvilinear base which allow the chair, upon assembly to rock thereon. At an edge of each sideboard 16 opposite the curvilinear base are a plurality of tenons 26 extending upward therefrom. Each of the sideboards 16 include a first slot 30 and a second slot 34. The first slot 30 extends inward from an edge of the sideboard 16. The second slot 34 is a vertical rectangular cutout from the sideboard 16. The second slot 32 is substantially perpendicular to the first slot 30. The sideboards 16 have eye-shaped cutouts 32 from which the armrests 18 are removed. The armrests 18 have a shape substantially similar to the shape of the eye shaped cutouts 32. Each armrest 18 includes a plurality of matise joints 28. The matise joints 28 are aligned with the tenons 26 of the sideboards for connection thereto. The sideboards 16 further include crescent-shaped cutouts 36 from which crescent shaped locking members 20 are removed.

The chair 10 is assembled by inserting the a side of the curved base of the back member having a respective locking hole 22 through a respective second slot 34 of a sideboard 16 so that the locking hole 22 is on an outer side of the sideboard 16. The second sideboard 16 is then connected to the back member 12 in a similar manner. The sideboard 16 are each received within a respective arc-shaped cutout of the back member 12. The seat member 14 is received by the first slot 30 of each sideboard 16. The side of the seat member 14 having the arc-shaped cutout is inserted first and upon sliding the seat member 14 along the length of the first slot 30, the arced cutout of the seat member is positioned adjacent and substantially perpendicular to the back member 12. Upon the first slot 30 receiving the seat member 14, the second locking holes 24 are perpendicularly aligned with the first locking holes 22 of the base of the back member. The chair 10 is secured by inserting a crescent shaped locking member 20 through the first locking hole 22 of the back member and further through the second locking hole 24 of the seat member. The locking member is frictionally fit within the locking holes 22, 24 for retaining the each of the back member 12 and seat member 14 between the sideboards 16.

FIG. 10 shows the chair 10 of the present invention as planar members that are disassembled. Upon removing the locking members 20 from each of the locking holes 22 and 24, the seat member 14 is selectively removed from the first slot 30 of the sideboard 16 and the sideboards 16 are removed from the back member 12. Thereafter, the sideboards 16, the back member 12 and the seat member 14 are stackable on top of one another. The armrests 18 are received within the eye-shaped cutouts 32 of the sideboard 16 and the locking member are received within the crescent shaped cutouts of the sideboard 16 for easy storage and/or transport thereof.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A collapsible rocker chair comprising:

a) a back member having an top section and a base having first locking holes extending through said base at a first and second distal end thereof;

b) a seat member having second locking holes extending through said seat member;

c) first and second sideboards having a curvilinear base, each of said sideboards having a first slot extending from an edge thereof and a second slot positioned substantially perpendicular to said first slot; and d) a first and second locking member each having a crescent shape, wherein said first distal end of said base is inserted though said second slot of said first sideboard and said second distal end of said base is inserted through said second slot in said second side board so that said first locking holes are positioned on an exterior side of each of said first and second sideboards, and said seat member is inserted into said first slot in each of said first and second sideboards thereby causing said second locking holes to be perpendicularly aligned with said first locking holes, wherein said first and second locking members are received through said first locking holes and further through said second locking holes thereby locking said back member and said seat member between each of said first and second sideboards.

2. The chair as recited in claim 1, wherein each of said sideboards includes a plurality of tenons extending from an edge opposite said curvilinear base.

3. The chair as recited in claim 2, further comprising first and second armrests each having a plurality of matise joints for receiving said plurality of tenons therein for removeably securing one of said first and second armrests to a respective one of said first and second sideboards.

4. The chair as recited in claim 3, wherein said first armrest is cutout of said first sideboard.

5. The chair as recited in claim 3, wherein said second armrest is cutout of said first sideboard.

6. The chair as recited in claim 1, wherein said first locking member is cutout of said first sideboard.

7. The chair as recited in claim 1, wherein said second locking member is cutout of said second sideboard.

8. The chair as recited in claim 1, wherein said top section of said back member is shaped substantially similar to an arrowhead.

9. The chair as recited in claim 1, wherein said seat member has an arc-shaped side.

10. The chair as recited in claim 9, wherein said arc-shaped side is inserted into said first slot in each of said first and second sideboards and upon complete insertion therein, is positioned adjacent to said back member.

* * * * *